US005472354A

United States Patent [19]

Chen et al.

[11] Patent Number: 5,472,354

[45] Date of Patent: Dec. 5, 1995

[54] ELECTRICAL CONNECTOR

[76] Inventors: Chou L. Chen, 8, Wufu 4th St., Taoyuan; Kow C. Lee, No. 50, Alley 18, Cheng Kon Sub-Ward, Chungli City, Taoyuan, both of Taiwan

[21] Appl. No.: 407,490

[22] Filed: Mar. 17, 1995

Related U.S. Application Data

[63] Continuation of Ser. No. 350,511, Dec. 6, 1994, abandoned, which is a continuation of Ser. No. 34,459, Mar. 18, 1993, abandoned.

[30] Foreign Application Priority Data

Mar. 19, 1992 [JP] Japan ..... 4-014941 U

[51] Int. Cl.[6] ..... H01R 13/627

[52] U.S. Cl. ..... 439/357; 439/65

[58] Field of Search ..... 439/65, 74, 79, 439/629, 680, 350, 355, 357, 358, 607

[56] References Cited

U.S. PATENT DOCUMENTS

| | | | |
|---|---|---|---|
| 4,420,209 | 12/1983 | Reis et al. | 339/91 R |
| 4,854,890 | 8/1989 | Nishimura | 439/607 |
| 4,895,535 | 1/1990 | Emadi et al. | 439/607 |
| 4,900,261 | 2/1990 | Gentry et al. | 439/357 |
| 4,938,701 | 7/1990 | Heberling | 439/65 |
| 5,004,430 | 4/1991 | Dellaudice et al. | 439/357 |
| 5,044,975 | 9/1991 | DiBene, II et al. | 439/357 |
| 5,110,302 | 5/1992 | Kobler | 439/357 |
| 5,199,884 | 4/1993 | Kanfman et al. | 439/74 |

FOREIGN PATENT DOCUMENTS

| | | |
|---|---|---|
| 0037014 | 5/1982 | Germany . |
| 147228 | 12/1990 | Taiwan . |
| 152103 | 2/1991 | Taiwan . |
| 161793 | 6/1991 | Taiwan . |
| 201034 | 2/1993 | Taiwan . |

*Primary Examiner*—Gary F. Paumen
*Assistant Examiner*—Hien D. Vu
*Attorney, Agent, or Firm*—Woodcock Washburn Kurtz Mackiewicz & Norris

[57] ABSTRACT

A two piece type electrical connector is provided which is matingly connect together boards in a designated correct polarity relation. A pair of first latch members L-shaped in cross-section are projected one at each end of a mother board-side housing and each have a ridge-like friction latch. A pair of second latch members L-shaped in cross-section are projected one at each end of a daughter board-side housing. One surface side of the second latch member has a projection inserted into the guide groove. One section of the projection has a recess-like friction latch frictionally engageable with the ridge-like friction latch. When the projection of the second latch member is inserted into the guide groove of the first latch member, the mother board-side housing is connected to the daughter board-side housing through the frictional engagement of the recess-like friction latch with the ridge-like friction latch so long as the mother board-side housing and daughter board-side housing are positioned in a designated correct relation.

6 Claims, 6 Drawing Sheets

ELECTRICAL CONNECTOR

This is a continuation, of application Ser. No. 08/350,511, filed Dec. 6, 1994, now abandoned, which is a continuation of application Ser. No. 08/034,459, filed Mar. 18, 1993, now abandoned.

BACKGROUND OF THE INVENTION

1. Field of the Invention

The present invention relates to an electrical connector for connecting together two boards.

2. Description of the Related Art

A board-to-board interconnect system for connecting together mother and daughter boards is known. In this system, two circuits of both surfaces of the mother board and two circuits of both surfaces of the daughter board are simultaneously connected by a pair of connectors.

The system comprises a plug housing attached to the edge portion of the daughter board and a receptacle housing attached to the edge portion of the mother board.

The plug housing supports two plug terminal rows corresponding to the two circuits of both the surfaces of the daughter board. The receptacle housing supports two receptacle terminal rows corresponding to the two circuits of both the surfaces of the mother boards.

The two plug terminal rows on the plug housing are molded in a blade-like fashion and arranged in a parallel array in close proximity in an electrically insulated fashion.

The two receptacle terminal rows of the receptacle housing are electrically insulated from each other in a spaced-apart relation. The two blade-like plug terminal rows can be matingly connected between the two receptacle terminal rows. Further, the respective receptacle terminal rows are of a cantilever beam type and can be brought in elastic contact with the blade-like terminal rows.

Further, the plug housing has a pair of guide pins projected from an inside at its middle and a pair of guide holes corresponding to associated guide pins of the plug housing are provided in an inside at a middle of the receptacle housing.

With these two housings attached to the edges of the corresponding boards, the two blade-like plug terminal rows are matingly connected to the two receptacle terminal rows. By so doing, the circuit on one surface of the mother board is electrically connected to the circuit on one surface of the daughter board and, at the same time, the circuit on the other surface of the mother board is electrically connected to the other surface of the daughter board.

Further, the two housings are mechanically connected together under a frictional force between the plug terminal row and the receptacle terminal row and an engaging force between the guide pin and the guide hole.

Only the frictional force and engaging force as set out about are not enough great to connect together these two housings, so that the housings are liable to be displaced away from each other and dropped.

The two terminal rows in the respective housing are provided in an entirely symmetrical relation. Therefore, even if one of these boards is inverted relative to the other board and hence their polarities are inverted for signal transfer to and from the boards, the two plug terminal rows can be matingly connected to the receptacle terminal rows, thus involving a risk that the mother board and daughter board will be connected together with their polarities wrongly set.

In order to prevent a connection error, it is conceivable that two terminal rows are non-symmetrically configured relative to the polarities of the boards so that the plug connection terminal rows can be connected to the receptacle connection terminal rows.

In this case, however, the configuration of the terminal is complicated so that the respective terminals are difficult to manufacture and mold.

It is also conceivable that pins are added to a connector device for correct polarity designation, but that the number of pins involved is increased.

SUMMARY OF THE INVENTION

It is accordingly the object of the present invention to provide an electrical connector which is simpler in structure and easier to manufacture and can positively connect together two housings with less number of component parts and do so with their polarities correctly designated.

According to the present invention, there is provided an electrical connector for connecting a first circuit board to a second circuit board, comprising:

a first housing mountable on the first circuit board, the first housing having guide grooves at both ends of the first housing, the guide groove having a first friction latch at one side of the width of the first housing;

a plurality of first contacts positioned in the first housing for establishing an electrical inter-connection to the first circuit board;

a second housing mountable on the second circuit board, the second housing having projections at both ends of the second housing, the projection having a second friction latch at one side of the width of the second housing; and a plurality of second contacts positioned in the second housing for establishing an electrical interconnection to the second circuit board;

whereby as the projection of the second housing is inserted in a predetermined direction into the guide groove of the first housing, the first and second housings are matingly connected to each other through the frictional engagement of the first friction latch with the second friction latch and the first and second contacts are matingly connected together.

According to an embodiment of the present invention, the first friction latch is a ridge-like friction latch and the second friction latch is a recess-like friction latch. It is preferable that the first housing comprises a inner insulating housing and an outer metal housing. In this case, the first contacts are positioned in the inner insulating housing. It is preferable that the second housing comprises a inner insulating housing and an outer metal housing. In this case, the second contacts are positioned in the inner insulating housing.

According to the electrical connector of the present invention, the projection at each end side section of the second housing is inserted into the corresponding guide groove at each end side section of the first housing and hence the second contacts are guided into the first contacts to achieve their electrical connection. Further, the first and second housings are mechanically connected together through the frictional engagement of the second friction latch of the projection with the first friction latch of the guide groove.

In this case, since the second friction latch is provided only on one surface of the projection, if the boards to be connected are misoriented in their polarities, then the first and second housings cannot be connected together and the first and second contacts cannot be connected together.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
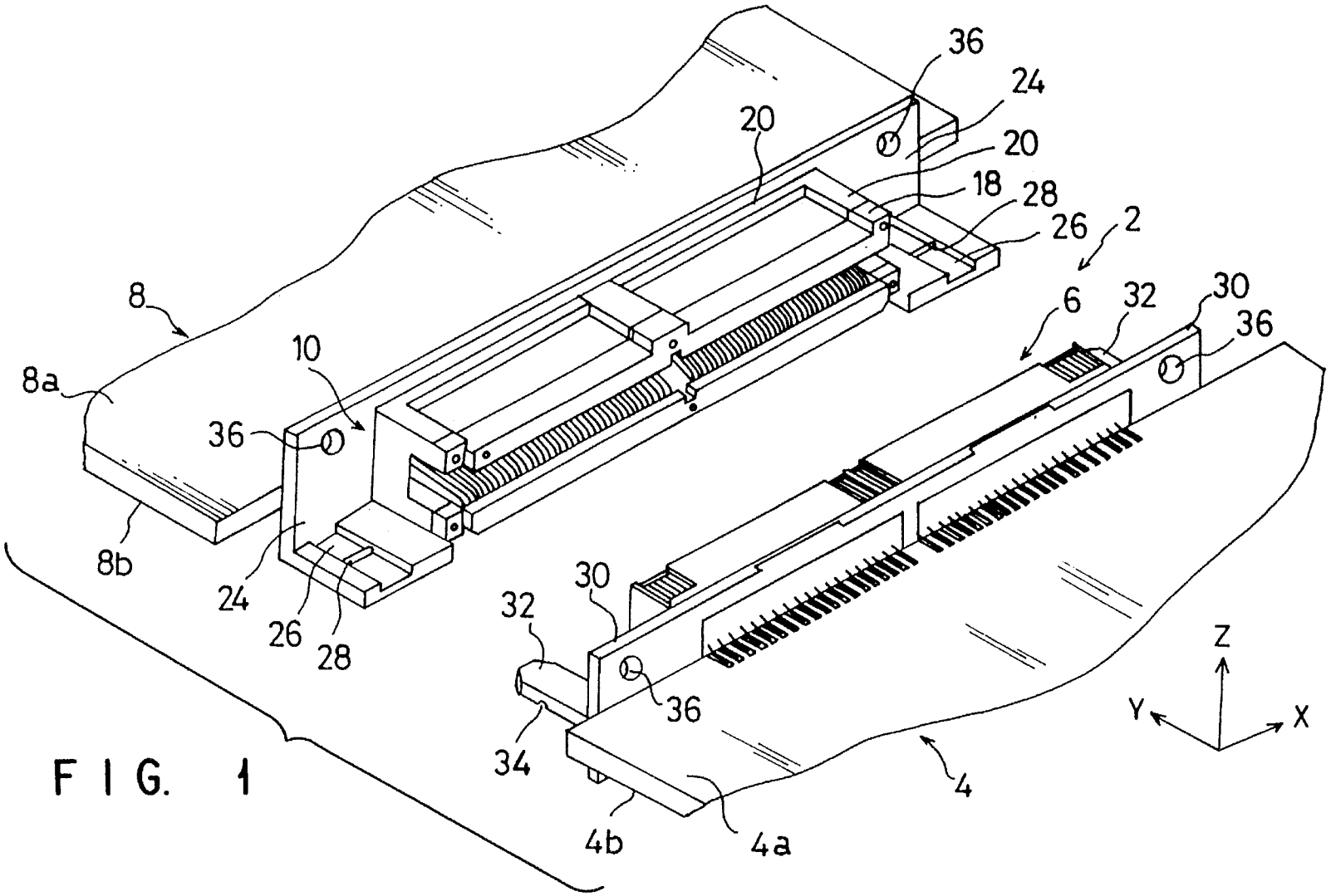
FIG. 1 is a perspective view showing an electrical connector according to an embodiment of the present invention.

In FIG. 1, an electrical connector 2 of the present invention is of such a two piece type that it has a plug housing 6 to be attached to the edge portion of a daughter board 4 and a receptacle housing 10 to be attached to the edge portion of a mother board 8. These two housings 6 and 10 can be matingly connected to each other. In FIG. 1 and the other FIGS., X denotes a longitudinal direction of the housings 6 and 10; Y a direction in which the housings 6 and 10 are matingly connected to each other; and Z a thickness direction of the boards 4 and 8.

Figure 2:
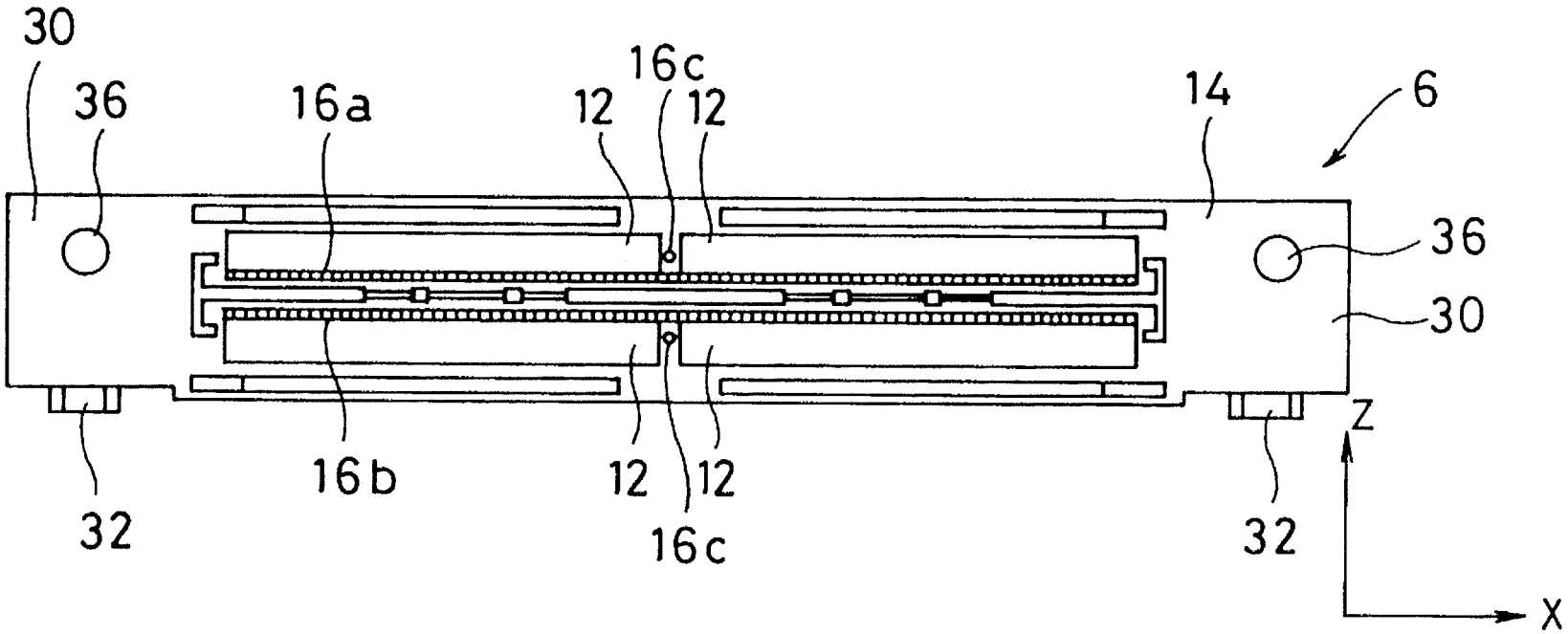
FIG. 2 is a front view showing a plug housing.

As shown in FIG. 2, the plug housing 6 comprises, in combination, an insulating plug inner resin body 12 and a plug outer metal body 14. Two plug contact rows **16*a* and 16*b* are arranged along the X direction of the housing 6 and molded in the insulating plug inner resin body 12 in an electrically insulating fashion. A pair of guide pins 16*c* are located in a middle of the plug outer metal body 14** such that they extend in the Y direction.

Figure 3:
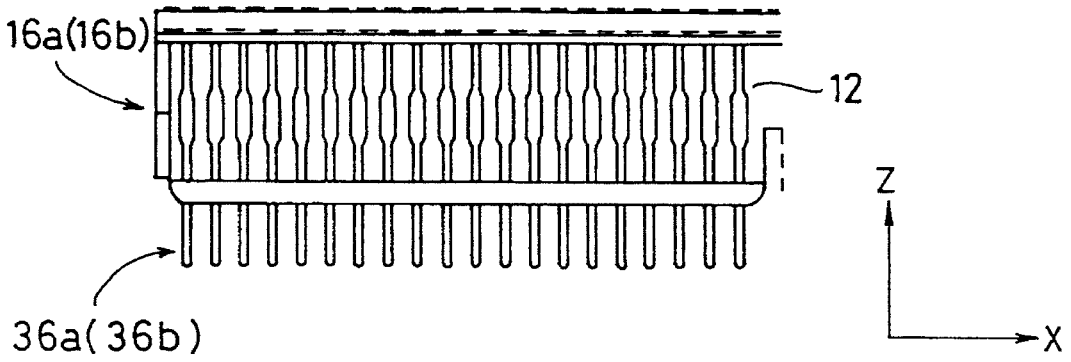
FIG. 3 is a side view showing a plug terminal row as a molded component.

As shown in FIG. 3 in particular, the plug contact rows **16*a* and 16*b* extend in the Y direction in a blade-like fashion. The blade-like plug contact rows 16*a* and 16*b* are arranged as a two-parallel array at a middle of a shorter side of the housing 6** such that they are located in close proximity.

Figure 4:
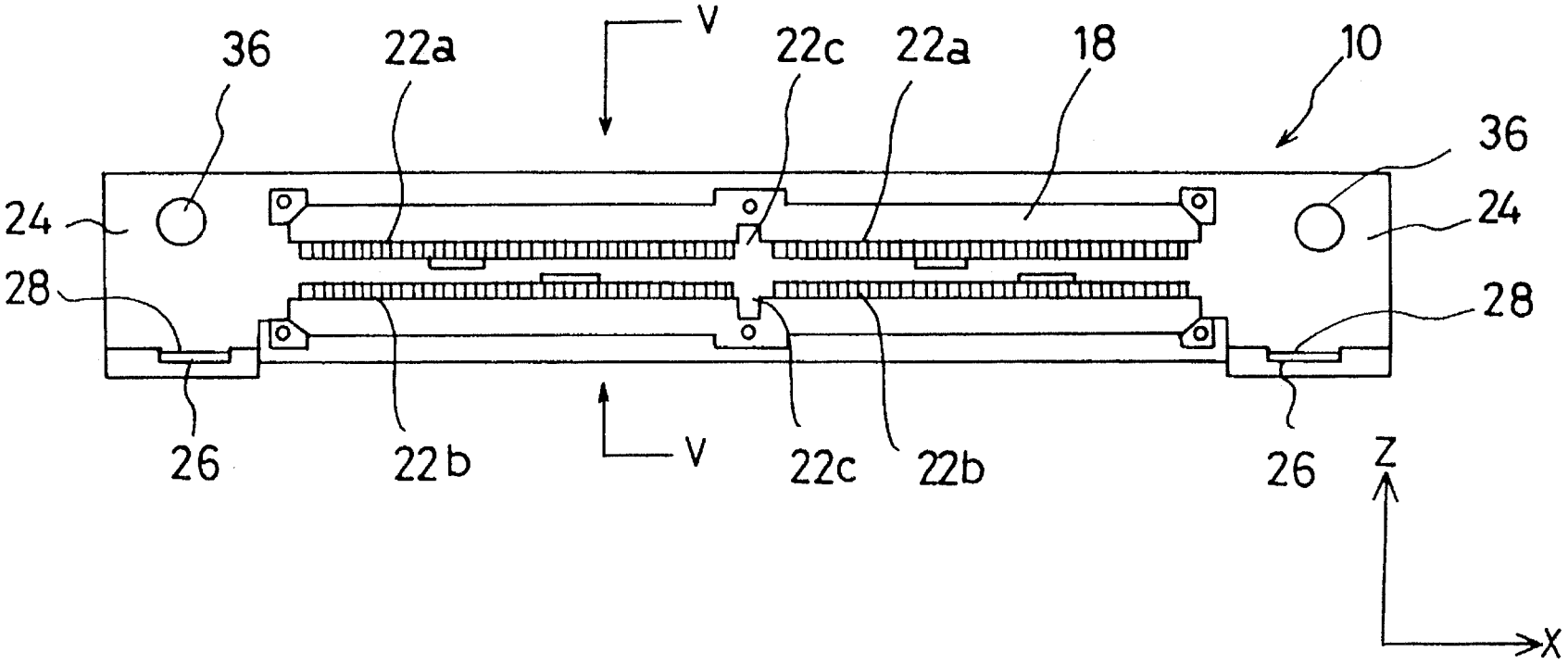
FIG. 4 is a front view showing a receptacle housing.
Figure 5:
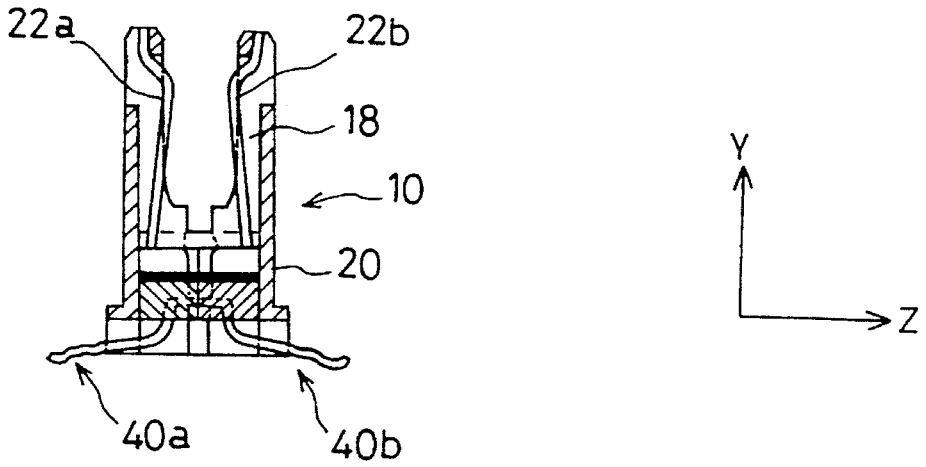
FIG. 5 is a cross-sectional view, taken along V—V in FIG. 4, showing an inner structure of the receptacle housing.

As shown in FIGS. 4 and 5, the receptacle housing 10 comprises, in combination, insulating receptacle inner resin body 18 and receptacle outer metal body 20. Receptacle contact arrays **22*a* and 22*b* are arranged, as a two-parallel array, along the longitudinal direction of the housing 10 such that they are molded in the insulating receptacle inner resin body 18 in an electrically insulated fashion. Guide pins 22*c* engaging the guide pins 16*c* of the plug housing 6 are formed at the middles of the insulating receptacle inner resin body 18**.

Figure 6:
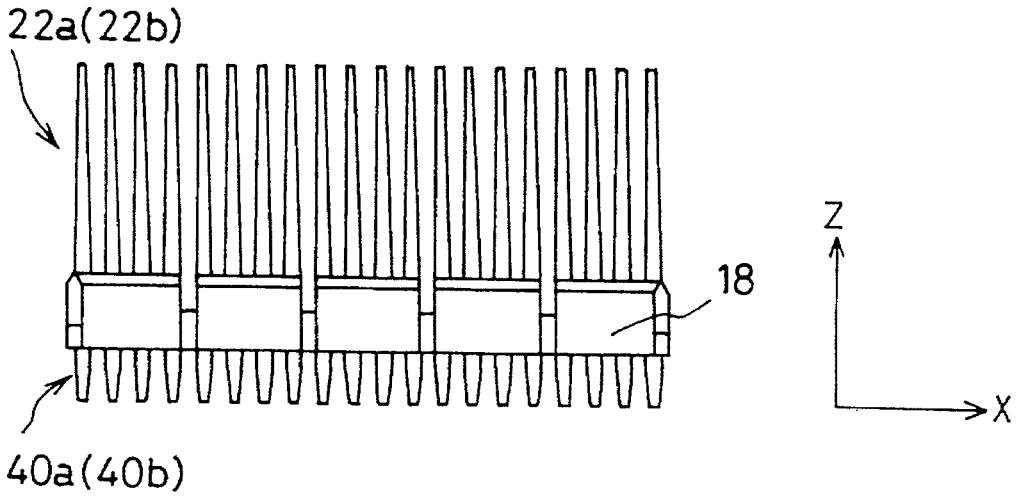
FIG. 6 is a side view showing a receptacle terminal row as a molded component.

The receptacle contact rows **22*a* and 22*b* as shown in FIGS. 4 to 6 face each other in a spaced-apart relation. The blade-like plug contact rows 16*a* and 16*b* are fitted between the receptacle contact rows 22*a* and 22*b***.

Those contacts in the receptacle contact rows **22*a* and 22*b*** are of a cantilever type and can be placed in elastic contact with the corresponding plug contacts.

The resin bodies 12 and 18 of the housings 6 and 10 prevent contact and short-circuiting between the contact rows **16*a*, 16*b* and 22*a*, 22*b* on one hand and the metal bodies 14, 20 on the other hand. These resin bodies 12 and 18** are formed of a material, such as zytel FR-50, commercially available under the trade name of E.I. Du Pont de Nemours & Co.

Figure 7:
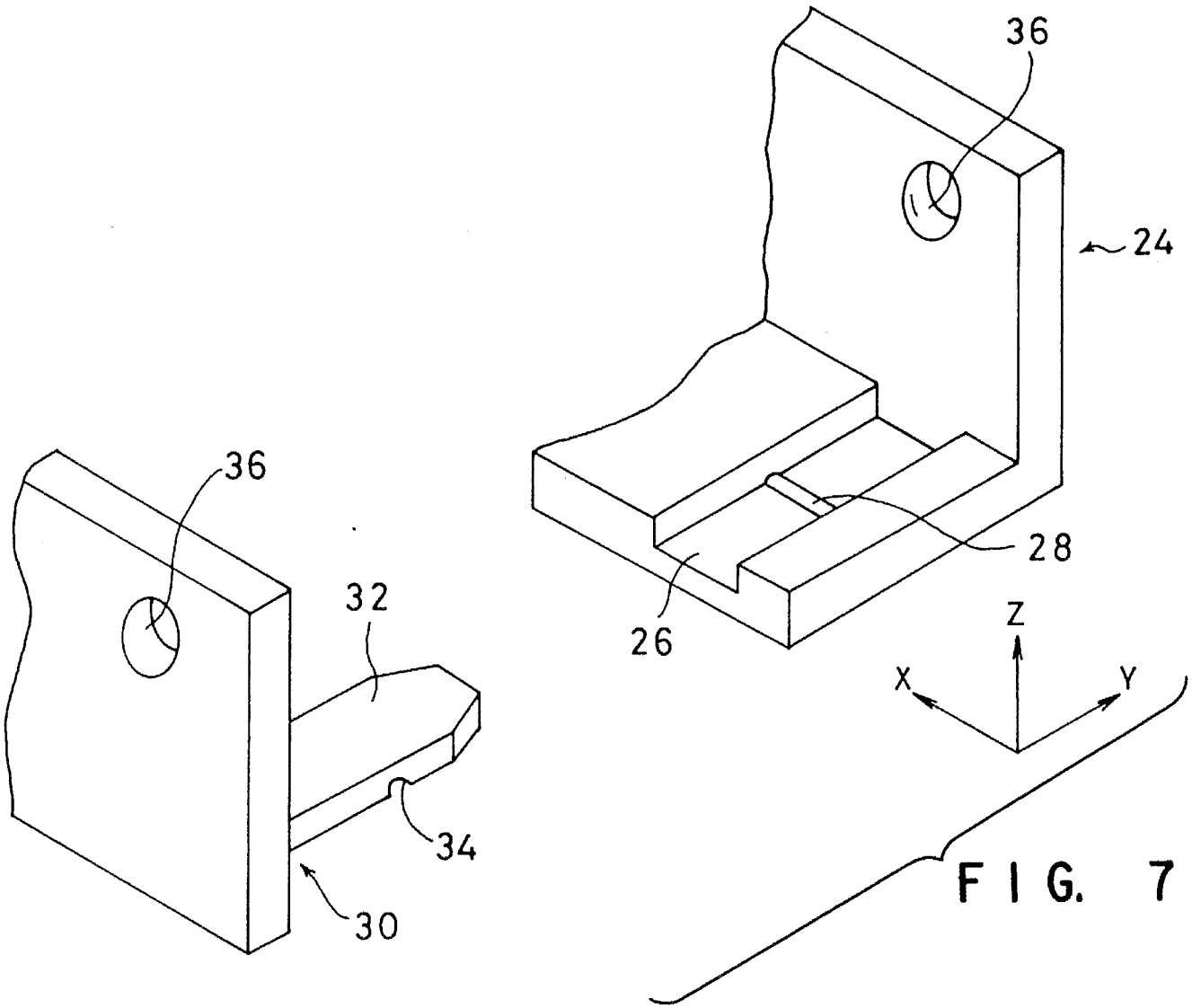
FIG. 7 is a perspective view, partly taken away, showing latch members.

As shown in FIG. 7 in particular, a pair of latch members 24 L-shaped in cross section extend integrally with both ends of the metal body 20 of the receptacle housing 10. One section of the latch member 24 has a guide groove 26 formed along a direction in which the plug contact rows **16*a*, 16*b* are matingly connected to the receptacle contact rows 22*a*, 22*b*. A ridge-like friction latch 28 is provided in the guide groove 26**.

A latch member 30 L-shaped in cross-section extends integrally from each end of the metal body 14 of the plug housing 6. The latch member 30 has a projection 32 at one end which is inserted into the guide groove 26. A recess-like friction latch 34 is provided in one surface of the projection 32 which frictionally enages the ridge-like friction latch 28.

Connecting together the daughter board 4 and mother board 8 by the connector device 2 is achieved as will be set out below.

Here solder tails **36*a* and 36*b* (See FIG. 3) on the plug terminal rows 16*a*, 16*b* of the plug housing 6 are soldered to corresponding solder pads 38 of a circuit on one surface 4*a* of the daughter board 4 and to corresponding solder pads (not shown) of a circuit on the other surface 8*b* of the daughter board 4. Similarly, solder tails 40*a* and 40*b* (see FIGS. 5 and 6) on the receptacle contact rows 22*a* and 22*b* of the receptacle housing 10 are soldered to corresponding solder pads of a circuit on one surface 8*a* of the mother board 8 and to corresponding solder pads of a circuit on the other surface 8*b* of the mother board 8. When the projection 32 of the latch member 30 of the plug housing 6 is inserted into the guide groove 26 in the latch member 24 of the receptacle housing 10, the recess-like friction latch 34 frictionally engages the ridge-like friction latch 28 so that the two housings 6 and 10** are connected together in a substantially horizontal fashion.

Here, since the recess-like friction latch 34 is provided only on one surface of the projection 32, only when the electrical polarities of daughter board 4 and mother board 8 are correctly set, the two housings 6 and 10 are connected together through the frictional engagement of the latches 28 and 34.

When the projection 32 is inserted into the guide groove, the paired guide pins **16*c* of the plug housing 6 are guided into engagement with the paired guide grooves 22*c* and, at the same time, these two housings 6 and 10 are matingly connected together. That is, the two housings 6 and 10 are matingly connected to each other through the engagement of the guide pin 16*c* with the guide groove 22*c* and frictional engagement of these frictional latches 28 and 34**.

Simultaneously with this connection, the plug contacts

16*a*, 16*b* are guided and fitted between the receptacle contact rows 22*a* and 22*b*. By so doing, the circuit on the surface 4*a* of the daughter board 4 is electrically connected to the circuit on the surface 8*a* of the mother board 4 and the circuit on the surface 4*b* of the daughter board 4 is electrically connected to the circuit on the surface 8*b* of the mother board 8.

Thus the paired latch members 24 on both ends of the housing 10 and paired latch members 30 on both ends of the housing 6 performs three functions: a polarity designating function, a contact (16*a*, 16*b*, 22*a*, 22*b*) guide function and a housing (6, 10) connection function. This fact is of advantage in that preparation can be made for a recent increase in the number of contacts in the connector device and narrowing of the pitch of the terminals in an array. That is, the whole size of the connector device can be minimized without sacrificing any insertion force with which the plug contact rows 16*a*, 16*b* are inserted between the receptacle contact rows 22*a* and 22*b*. It is further possible to achieve positive connection between the boards 4 and 8.

In the aforementioned embodiment, it is preferable that the guide groove 26 of the latch member 24 on the receptacle housing 10 be displaced from a center line 24*a* of the latch member 24. In this case, if one of these boards 4 and 8 is inverted, then the projection 32 cannot be entirely fitted in the guide groove 26, thus ensuing a positive correct designation of their polarities.

It is preferable that a pair of screw holes 36 each provided at the other end of latch member (24, 30) face each other. In this case, since these housings 6 and 10 are fixed as one unit to each other by screw means, not shown, more positive connection can be made between the housings 6 and 10.

The present invention is not restricted to the aforementioned embodiment and various changes or modifications of the present invention can be made without departing from the spirit and scope of the present invention. Although, in the aforementioned embodiment, the latch members 24 and 30 having the guide groove 26 and projection 32, respectively, are provided on the receptacle housing 10 and plug housing 6, the latch members 24 and 30 may be provided on the plug housing 6 and receptacle housing 10, respectively, instead.

Alternatively, a header housing 6 and receptacle housing 10 may be provided on a mother board 8 and daughter board 4, respectively.

According to the connector of the present invention, the board-polarity designation function, contact row guide function and positive housing connection function can be collectively integrated at both ends of the housings. Thus the connector of the present invention, even if being equipped with many contacts in a narrower pitch array, can be made as small in size as possible without sacrificing any insertion force with which the contact rows on one side are matingly connected to the contacts on the other side. By so doing, it is possible to achieve a positive correct connection between two circuit boards.

Since the aforementioned functions can be achieved by a simple structure comprised of the projection and guide groove having the recess like friction latch and ridge-like friction latch, respectively. This achieves a readier manufacture of an electrical connector with less component parts.

What is claimed is:

1. An electrical connector for connecting a first circuit board to a second circuit board, comprising:

a first housing mountable on the first circuit board, the first housing having a first latching member extending longitudinally from each end of the first housing, each of the first latching members having a guide groove which is parallel with a mating direction of the first housing and including a transverse ride positioned in the guide groove and at least partially intersecting the guide groove normal to the mating direction of the first housing;

a plurality of first contacts positioned in the first housing for establishing an electrical interconnection to the first circuit board;

a second housing mountable on the second circuit board, the second housing having a second latching member extending longitudinally from each end of the second housing, each of the second latching members having a projection which is parallel with a mating direction of the second housing and including a transverse recess which is at least partially intersecting the projection normal to the mating direction of the second housing; and a plurality of second contacts positioned in the second housing for establishing an electrical interconnection to the second circuit board;

whereby as the projection of the second housing is fittedly inserted into the guide groove of the first housing, the first and second housings are matingly connected and latched to each other through a frictional engagement of the transverse ridge and the transverse recess and the first and second contacts are matingly connected together.

2. The electrical connector of claim 1, wherein the first housing comprises a receptacle outer metal body, the first latching members being formed as part of the receptacle outer metal body, and wherein the second housing comprises a plug outer metal body, the second latching members being formed as part of the plug outer metal body;

whereby an electrical shield is formed around the first and second contacts and sustained through the frictional engagement of the transverse ridge and the transverse recess when the housings are matingly connected to each other.

3. The electrical connector of claim 2, wherein the first housing comprises an insulating receptacle inner resin body.

4. The electrical connector of claim 2, wherein the second housing comprises an insulating plug inner resin body.

5. The electrical connector of claim 1, wherein each of the first latching members comprises a first base leg and a first endwall leg integrally connected together and substantially forming an L-shape with each of the first base legs extending longitudinally from the bottom surface of the first housing, one first base leg extending from each end of the first housing, and the first endwall leg extending longitudinally from the first endwall surface of the first housing, one first endwall leg extending from each end of the first housing, each of the guide grooves being formed in the first endwall leg of a respective first latching member.

6. The electrical connector of claim 1, wherein each of the second latching members comprises a second base leg and a second endwall leg integrally connected together and substantially forming an L-shape with each of the second base legs extending longitudinally from the bottom surface of the second housing, one second base leg extending from each end of the second housing, and the second endwall leg extending longitudinally from the second endwall surface of the second housing, one second endwall leg extending from each end of the second housing, and wherein at least a part of the second endwall leg forms the projection of a respective second latching member.

* * * * *